US009616697B2

(12) United States Patent
Chen et al.

(10) Patent No.: US 9,616,697 B2
(45) Date of Patent: Apr. 11, 2017

(54) BLANKET FOR TRANSFERRING A PASTE IMAGE FROM AN ENGRAVED PLATE TO A SUBSTRATE

(71) Applicant: LEE CHANG YUNG CHEMICAL INDUSTRY CORPORATION, Kaohsiung (TW)

(72) Inventors: Chia-Yin Chen, Kaohsiung (TW); Chuan-Jen Fu, Zhongliao Township, Nantou County (TW); Hsin-Jung Lin, Taipei (TW); Ruoh-Huey Uang, Zhudong Township, Hsinchu County (TW)

(73) Assignee: LCY Chemical Corp., Kaohsiung (TW)

( * ) Notice: Subject to any disclaimer, the term of this patent is extended or adjusted under 35 U.S.C. 154(b) by 0 days.

(21) Appl. No.: 14/632,797

(22) Filed: Feb. 26, 2015

(65) Prior Publication Data

US 2016/0250879 A1 Sep. 1, 2016

(51) Int. Cl.
*B41C 3/08* (2006.01)
*B41N 10/04* (2006.01)

(52) U.S. Cl.
CPC ..... *B41N 10/04* (2013.01); *B41N 2210/02* (2013.01); *B41N 2210/04* (2013.01); *B41N 2210/14* (2013.01)

(58) Field of Classification Search
CPC ..... B41N 10/04
USPC ..... 101/401.1
See application file for complete search history.

(56) References Cited

U.S. PATENT DOCUMENTS

| | | | | |
|---|---|---|---|---|
| 4,372,246 | A * | 2/1983 | Azar | G03G 15/2057 118/60 |
| 5,026,591 | A * | 6/1991 | Henn | B01D 69/10 428/198 |
| 5,352,507 | A * | 10/1994 | Bresson | B41N 10/04 428/304.4 |
| 6,871,591 | B2 * | 3/2005 | Buono | B41N 10/02 101/375 |
| 7,717,037 | B2 * | 5/2010 | Czeranka | B41F 7/26 101/147 |
| 2003/0078309 | A1 * | 4/2003 | Koffler | C08J 9/04 521/79 |
| 2005/0247222 | A1 * | 11/2005 | McLean | B41C 1/00 101/401.1 |
| 2006/0100343 | A1 | 5/2006 | Osawa | |

(Continued)

FOREIGN PATENT DOCUMENTS

| | | | |
|---|---|---|---|
| CN | 101140442 | A | 3/2008 |
| CN | 103513549 | A | 1/2014 |

(Continued)

OTHER PUBLICATIONS

Taiwanese Office Action dated Nov. 18, 2015, as issued in corresponding Taiwan Patent Application No. 104108580 (6 pages).

*Primary Examiner* — Anthony Nguyen
(74) *Attorney, Agent, or Firm* — Muncy, Geissler, Olds & Lowe, P.C.

(57) ABSTRACT

A blanket for transferring a paste image from an engraved plate to a substrate is provided. The blanket includes a foam; a supporting layer on the foam; and a paste transfer layer on the supporting layer. The paste transfer layer is an interpenetrating polymer network of silicone rubber and fluoroelastomer.

16 Claims, 6 Drawing Sheets

(56) References Cited

U.S. PATENT DOCUMENTS

| | | | | |
|---|---|---|---|---|
| 2006/0185541 | A1* | 8/2006 | Czeranka | B41F 7/26 101/376 |
| 2007/0205533 | A1 | 9/2007 | Matsuda et al. | |
| 2007/0277690 | A1* | 12/2007 | Gervasi | B41M 5/0256 101/368 |
| 2011/0223432 | A1 | 9/2011 | Ro et al. | |
| 2013/0008330 | A1* | 1/2013 | Yoo | B41N 10/04 101/401.1 |
| 2014/0060365 | A1* | 3/2014 | Gervasi | C09D 127/16 101/451 |

FOREIGN PATENT DOCUMENTS

| | | | |
|---|---|---|---|
| JP | 2011042068 | A | 3/2011 |
| JP | 2013091310 | A1 | 5/2016 |

* cited by examiner

BLANKET FOR TRANSFERRING A PASTE IMAGE FROM AN ENGRAVED PLATE TO A SUBSTRATE

BACKGROUND OF THE INVENTION

Field of the Invention

The disclosure relates to gravure offset printing, and in particular it relates to a blanket of the gravure offset printing.

Description of the Related Art

Printed electronic products possess great market potential. There is a continuing goal to miniaturize. To satisfy the design requirements of lighter, smaller, or thinner products, the volume of each component utilized in the product is strictly limited. Taking conductive wires—the most common component in printed electronic products—as an example, the line width thereof is reduced from the hundred-micron scale to a scale of just several microns. Screen printing is typically used in the manufacture of traditional conductive wires. However, the mass-producible line width is only down to 70 μm due to the intrinsic limitations of the screen. Obviously, such a process capability is insufficient for processing currently popular touch panels. To achieve fine wire production, most manufacturers rely on photolithographic technology. Although this process can produce wires with a line width less than 10 microns, the production cost is significantly higher than that of the printing process. Moreover, this process is not environmentally friendly because of the huge consumption of energy and materials.

To meet the production capacity of thin conductive paths and manufacturing cost considerations, gravure transfer (gravure offset printing) technology has seen a lot of research and trial production in industry in recent years, but the blanket of the gravure offset printing still needs to be improved. For example, a paste transfer layer of a blanket for the gravure transfer may swell due to long-term contact with the solvent in the paste. The swelled paste transfer layer may negatively influence the line width uniformity of the transferred paste, and even degrade the conductivity of a whole substrate with the transferred paste thereon. In addition, the swelling problem may shorten the product lifespan of the blanket, thereby increasing the processing cost. Fluoroelastomer has been selected to serve as a paste transfer layer by some skilled in the art to solve the above swelling problem. However, the phenomenon of the paste transfer layer absorbing solvent is a necessary phenomenon during the gravure transfer. If the paste transfer layer is entirely composed of the fluoroelastomer, it cannot effectively absorb the solvent and therefore lowers the transfer quality.

Accordingly, a novel blanket to solve the above problems is called for.

BRIEF SUMMARY OF THE INVENTION

One embodiment of the disclosure provides a blanket for transferring a paste image from an engraved plate to a substrate, comprising: a foam; a supporting layer on the foam; and a paste transfer layer on the supporting layer, wherein the paste transfer layer is an inter-penetrating network of silicone rubber and fluoroelastomer.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
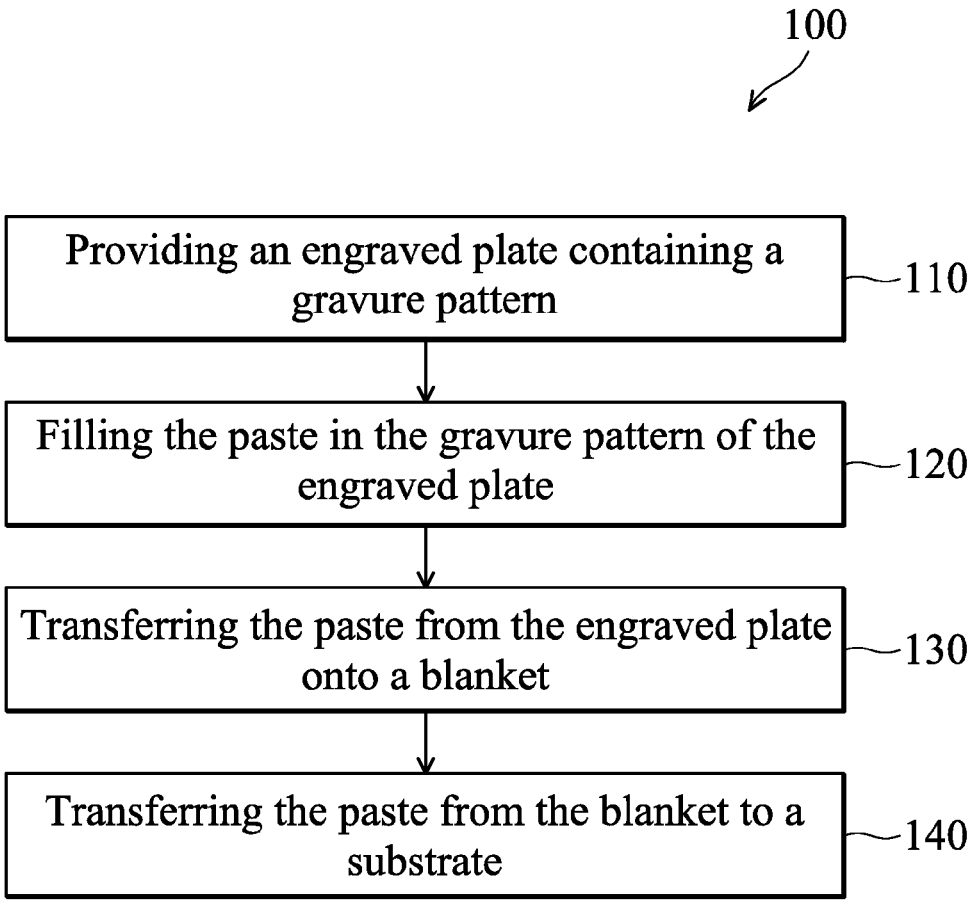
FIG. 1 shows a flowchart of the gravure offset printing process in one embodiment of the disclosure.
Figure 2A:
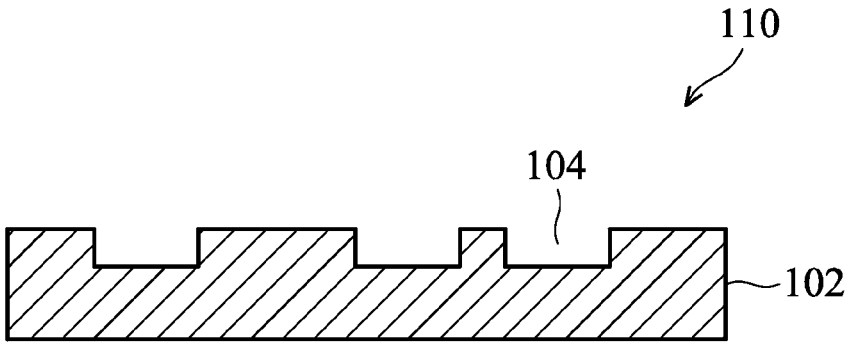
FIGS. 2A-2E show schematic views of various stages of the gravure offset printing process in one embodiment of the disclosure.
Figure 2B:
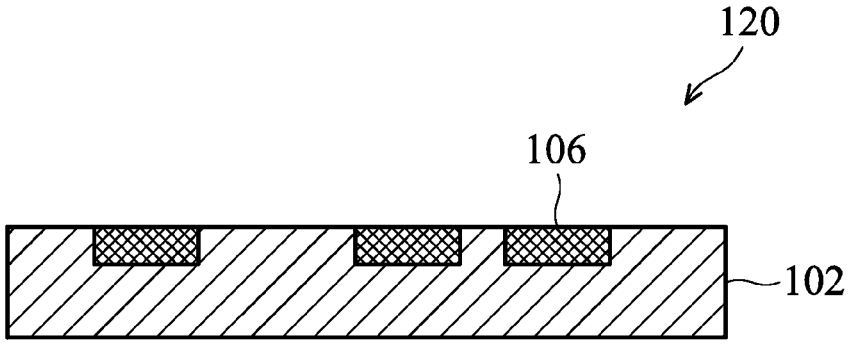

In one embodiment, a gravure transfer process flow is provided as shown in FIG. 1. The process 100 begins at step 110, in which an engraved plate 102 with an intaglio pattern 104 is provided. As shown in FIG. 2A, the intaglio pattern 104 may have a width, for example 3 μm to 100 μm. The engraved plate 102 can be made of stainless steel, glass, ceramic, copper, or a combination thereof. Subsequently, a paste 106 is filled into the intaglio pattern 104 in step 120. The excess paste 106 over the surface of the engraved plate 102 can be removed by a doctor blade, such that the top surface of the engraved plate 102 is flat, as shown in FIG. 2B. In one embodiment, the paste 106 can be made of metal particles, polymer binder, and organic solvent.

Figure 2C:
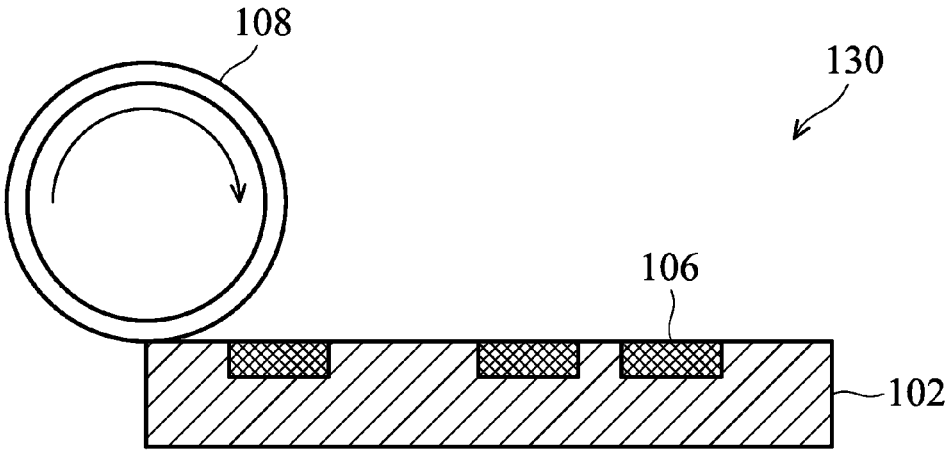
Figure 3A:
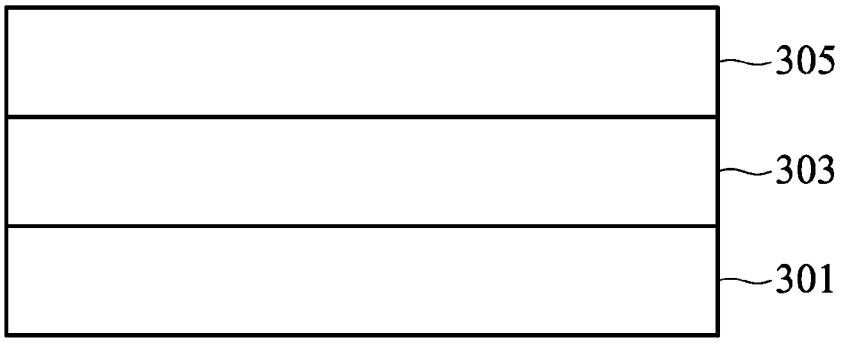
FIGS. 3A-3D shows schematic views of the blankets in embodiments of the disclosure.

Referring to FIG. 2C, the process 100 proceeds to step 130, in which the paste 106 in the intaglio pattern 104 is transferred to the surface of a blanket 108. The blanket 108 may be, for example, a roller shape. In one embodiment, the blanket 108 is a three-layered structure of a foam 301, a supporting layer 303 on the foam 301, and an paste transfer layer 305 on the supporting layer 303, as shown in FIG. 3A. The three-layered structure can be rolled as a roll (the blanket 108 in FIG. 2C), and the paste transfer layer 305 is the outermost layer to transfer the paste 106.

In one embodiment, the foam 301 can be made of polyurethane with a Shore A hardness of 20 to 80. The polyurethane of the foam 301 with an overly high or low density may make the foam 301 have an overly high or low Shore A hardness. For example, the foam can be AM60HD with a Shore A hardness of 35 or AF series with a Shore A hardness of 20, which are commercially available from Adheso Graphics, Inc. In one embodiment, the foam 301 has a thickness of 0.5 mm to 2.0 mm. Overly thick foam may lead little blanket engagement into gravure so that paste off ratio will be decreased. Overly thin foam may lead to a poor supporting ability so that the product lifespan of blanket will be decreased.

In one embodiment, the supporting layer 303 has a thickness of 100 μm to 300 μm. A supporting layer with a thickness greater than 300 μm may increase the rigidity and lower the flexibility of the blanket, such that the blanket cannot intimate contact the printing apparatus (e.g. the engraved plate 102) and therefore degrading the printing result. If a supporting layer has a thickness less than 100 μm, it will be easily wrinkle or broken and fail to support the blanket. In one embodiment, the supporting layer 303 has a thickness of 100 μm to 300 μm. An overly thick supporting layer may lead to overly high hardness of the blanket. An overly thin supporting layer may lead to an overly low supporting capacity of the blanket.

In one embodiment, the ink transfer layer 305 can be an inter-penetrating polymer network (IPN) of a silicone rubber and a fluoroelastomer. For example, the silicone rubber, the fluoroelastomer, and crosslinking agent can be mixed. The silicone rubber in the mixture is crosslinked to form a first polymer network, and the fluoroelastomer is then crosslinked to form a second polymer network, wherein the first polymer network and the second polymer network are inter-penetrated. In one embodiment, the silicone rubber can be crosslinked (cured) by addition cure, peroxide cure, condensation cure, or the like. In one embodiment, the silicone rubber can be dimethylpolysiloxane, and the fluoroelastomer can be perfluoropolyether with a terminal silicon having vinyl group, and the crosslinking agent can be platinum. Alternately, the fluoroelastomers can be perfluoropolyether, terpolymer composed of vinylidene fluoride (VDF) having —$(CH_2CF_2)_x$— (vinylidene fluoride) subunit, hexafluoropropylene (HFP) having —$(CF_2CF(CF_3))_y$— (hexafluoropropylene) subunit, and tetrafluoroethylene (TFE) having —$(CF_2CF_2)_z$— (tetrafluoroethylene) subunit, where x is 30 to 90 mole %, y is 10 to 70 mole %, z is 0 to 34 mole %, and x+y+z=100 mole %. While the crosslinking temperature (i.e. 130° C.) and the crosslinking period (i.e. 10 minutes) of the silicone rubber are less than those (i.e. 150° C. and 1 hour) of the fluoroelastomer, the platinum may crosslink the silicone rubber without crosslinking the fluoroelastomer. While the silicone rubber and the fluoroelastomer are crosslinked in different periods, the polymer works thereof may form an IPN structure. Alternatively, the silicone rubber and the fluoroelastomer can be crosslinked by a different crosslinking agent or even different crosslinking mechanisms. For example, the silicone rubber can be crosslinked by other crosslinking mechanisms (such as addition crosslinking, peroxide crosslinking, or condensation crosslinking) rather than the platinum crosslinking. Note that if the silicone rubber and the fluoroelastomer are just blended without inter-penetrating, they can't be separated from the constituent polymer network(s) without breaking chemical bonds.

In one embodiment, the paste transfer layer 305 has a thickness of 0.5 mm to 1 mm. An overly thick paste transfer layer 305 may lead too much strain remaining in the blanket so that the printing shape twists and distorts. An overly thin paste transfer layer 305 may lead to the whole blanket composite being too hard to print moderately, which results from the hardness of supporting dominate the hardness of the whole blanket. In one embodiment, the silicone rubber and the fluoroelastomer in the paste transfer layer 305 have a volume ratio of 80:20 to 50:50. An overly high volume ratio of the silicone rubber cannot solve the swelling problem of the paste transfer layer 305. The paste transfer layer 305 with an overly low volume ratio of the silicone rubber cannot effectively absorb the solvent of the paste, lowering the transfer quality. In one embodiment, the paste transfer layer 305 has a fluorine content of 2 wt % to 50 wt %, which can be measured by scanning electron microscope/energy dispersive spectrometer. A paste transfer layer with an overly low fluorine content cannot solve the swelling problem of the paste transfer layer 305. A paste transfer layer with an overly high fluorine content cannot effectively absorb the solvent of the paste and therefore the transfer quality is lowered. In one embodiment, a solvent swelling ratio of the paste transfer layer 305 and a solvent swelling ratio of a pure silicone rubber layer (having a thickness similar to the paste transfer layer 305) have a ratio of 50:100 to 80:100. A paste transfer layer with an overly high solvent swelling degree cannot solve the swelling problem of the paste transfer layer 305. The paste transfer layer 305 with an overly low solvent swelling degree cannot effectively absorb the solvent of the paste, lowering the transfer quality.

The surface of the paste transfer layer 305 and water may have a contact angle of 100° to 130°. An overly low contact angle means the paste transfer layer 305 is more hydrophilic, and it may keep too much paste on the blanket and cannot get 100% of the paste to transfer. An overly high contact angle means the paste transfer layer 305 is too hydrophobic, and it may have poor ability to take paste from the gravure. In one embodiment, the paste transfer layer 305 has a surface roughness of 0.05 μm to 0.2 μm. A paste transfer layer with an overly high surface roughness may make the paste leakage to widen the pattern line width. A paste transfer layer with an overly low surface roughness may make the solvent of the paste be not easily absorbed by the blanket. Moreover, an adhesive (not shown) can be disposed between the foam 301 and the supporting layer 303, between the supporting layer 303 and the paste transfer layer 305, or a combination thereof. The adhesive may further enhance the adhesion between the layers in the blanket 108, thereby eliminating the chance of delamination during the gravure transfer process. The adhesive can be made of silicone, epoxy, or silane.

Figure 3B:
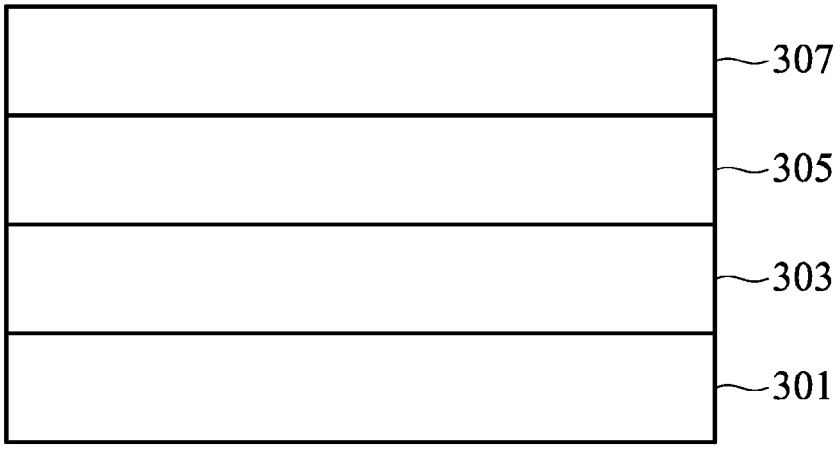
Figure 3C:
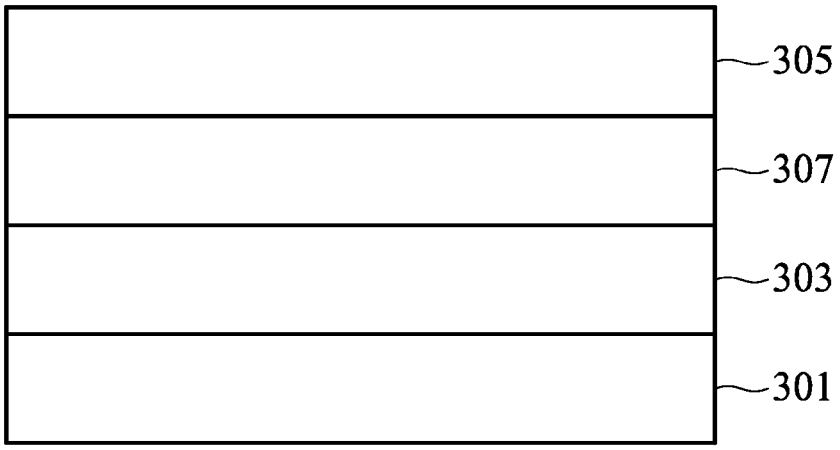
Figure 3D:
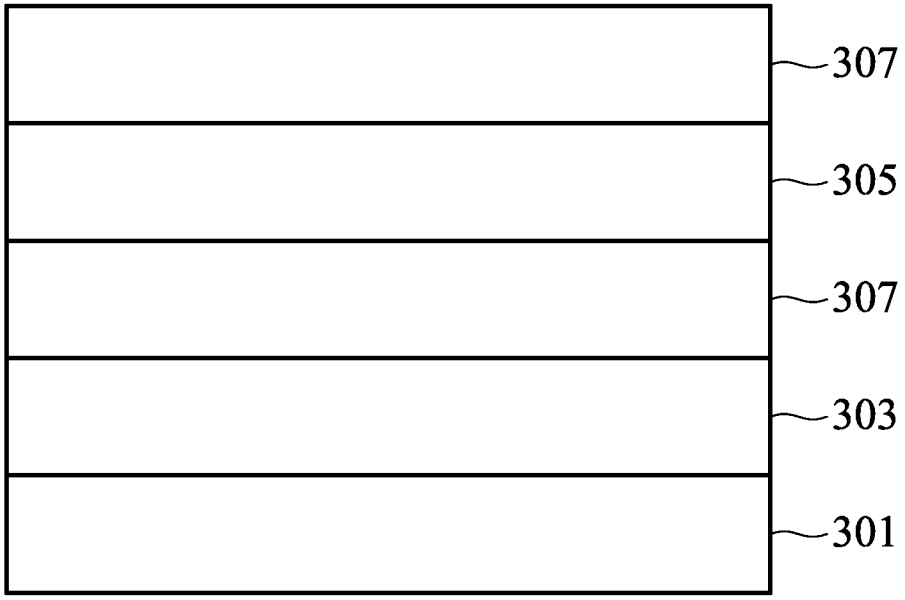

In another embodiment, a silicone rubber layer 307 can be formed on the paste transfer layer 305 as shown in FIG. 3B. In addition, the silicone rubber layer 307 can be formed between the paste transfer layer 305 and the supporting layer 303, as shown in FIG. 3C. Alternatively, the silicone rubber layers 307 can be formed on the paste transfer layer 305 and between the paste transfer layer and the supporting layer 303, as shown in FIG. 3D. In one embodiment, the silicone rubber layer 307 has a thickness of 0.5 mm to 2 mm. The silicone rubber layer may modify the solvent absorption rate. Moreover, an adhesive (not shown) can be disposed between the paste transfer layer 305 and the silicone rubber layer 307 to enhance the adhesion therebetween, thereby eliminating the chance of delamination during the gravure transfer process. The adhesive can be made of silicone, epoxy, or silane.

Figure 2D:
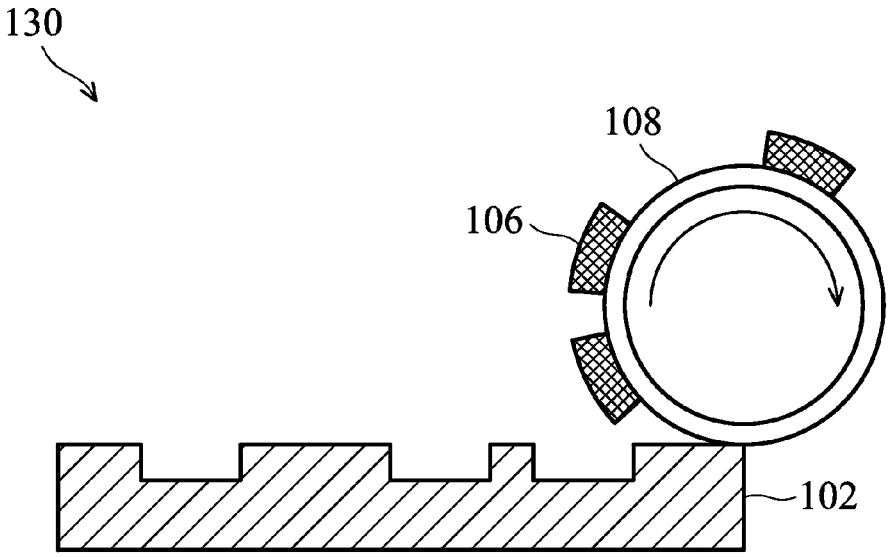
Figure 2E:
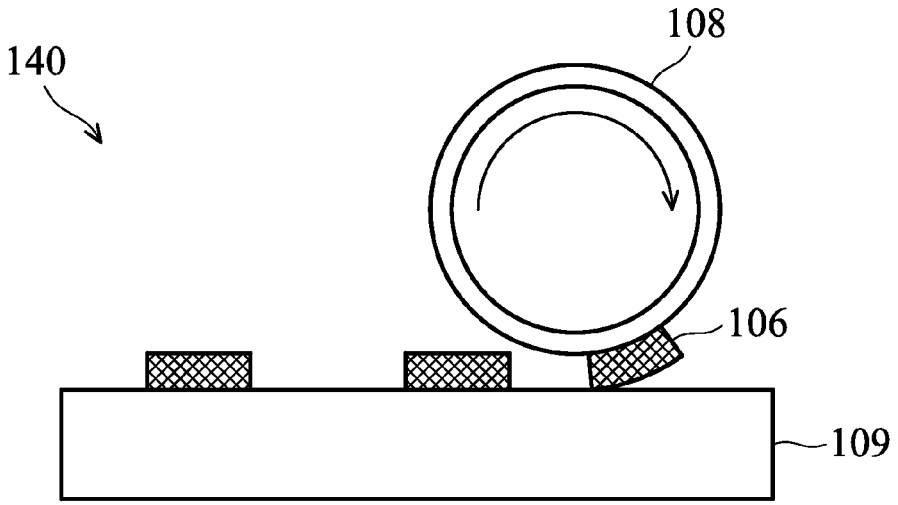

Referring to FIG. 2D, the process 100 proceeds to step 140, in which the paste 106 on the blanket 108 is transferred to a substrate 109. Note that although the substrate 109 is shown as being planar, the disclosure is not limited thereto. For example, the substrate 109 can be curved. The substrate 109 can be made of a rigid substrate or a flexible-type substrate, i.e. glass, polyethylene terephthalate (polyethylene terephthalate; PET), or a combination thereof.

Referring to FIG. 2D, the process 100 proceeds to step 140, in which the paste 106 on the blanket 108 is transferred to a substrate 109. Note that although the substrate 109 is shown as being planar, the disclosure is not limited thereto. For example, the substrate 109 can be curved. The substrate 109 can be made of a rigid substrate or a flexible-type substrate, i.e. glass, polyethylene terephthalate (polyethylene terephthalate; PET), or a combination thereof.

It should be understood that the yield of the gravure transfer process is determined on two critical points: (1) the yield of the paste 106 transferred from the engraved plate 102 to the blanket 108, and (2) the yield of the paste 106 transferred from the blanket 108 to the substrate 109. In other words, the paste 106 tends to attach to the substrate 109 rather than attaching to the blanket 108, and it also tends to attach to the blanket 108 rather than to the engraved plate 102. The above attachment can be controlled by the pressure and temperature between the engraved plate 102 and the blanket 108 as well as between the blanket 108 and the substrate 109. Furthermore, the Tan δ value (0.05 to 0.13) of the blanket 108 is critical for the product yield. While the gravure transfer process is a continuous process, a stable blanket 109 may prevent the distortion of the printed line width and blanket aging.

Referring to FIG. 2D, the process 100 proceeds to step 140, in which the paste 106 on the blanket 108 is transferred to a substrate 109. Note that although the substrate 109 is shown as being planar, the disclosure is not limited thereto. For example, the substrate 109 can be curved. The substrate 109 can be made of a rigid substrate or a flexible-type substrate, i.e. glass, polyethylene terephthalate (polyethylene terephthalate; PET), or a combination thereof.

It should be understood that the yield of the gravure transfer process is determined on two critical points: (1) the yield of the paste 106 transferred from the engraved plate 102 to the blanket 108, and (2) the yield of the paste 106 transferred from the blanket 108 to the substrate 109. In other words, the paste 106 tends to attach to the substrate 109 rather than attaching to the blanket 108, and it also tends to attach to the blanket 108 rather than to the engraved plate 102. The above attachment can be controlled by the pressure and temperature between the engraved plate 102 and the blanket 108 as well as between the blanket 108 and the substrate 109. Because the paste transfer layer 305 is the IPN of the silicone rubber and fluoroelastomer, it is free of the swelling problem after long-term use, and the product lifespan of the blanket 108 is efficiently increased.

Below, exemplary embodiments will be described in detail with reference to the accompanying drawings so as to be easily realized by a person having ordinary knowledge in the art. The inventive concept may be embodied in various forms without being limited to the exemplary embodiments set forth herein. Descriptions of well-known parts are omitted for clarity, and like reference numerals refer to like elements throughout.

EXAMPLES

In the following Examples, the silicone rubber was dimethyl polysiloxane (KE-1990, Mw=1000~100000) commercially available from Shin-Etsu Chemical Co., Ltd. The fluoroelastomer was perfluoropolyether with terminal silicon having vinyl groups (SIFEL 2610) commercially available from Shin-Etsu Chemical Co., Ltd. The supporting layer was C8FH (thickness=250 μm) commercially available from ShinPEX. The foam was AM60HD with a Shore A hardness of 35, commercially available from Adheso Graphics, Inc. The adhesive was silicone adhesive SL989 commercially available from Starsilicone.

Example 1

Different volume ratios of the silicone rubber and fluoroelastomer were mixed. The mixture was thermal pressed at 130° C. for 10 minutes to crosslink (cure) the silicone rubber, and then heated at 150° C. for 60 minutes to crosslink (cure) the fluoroelastomer, thereby forming an inter-penetrating polymer network (IPN) of the silicone rubber and the fluoroelastomer. The IPN composition was molded to a blanket sample of 0.5 mm to 1.0 mm. The sample was dipped in terpineol for 72 hours to measure its density and weight change to calculate its solvent swelling ratio, as tabulated in Table 1. In addition, the contact angle between the surface of the sample and water was measured by ASTM D7334-08 (2013) and tabulated in Table 1.

TABLE 1

| | Control group | 1-1 | 1-2 | 1-3 | 1-4 |
|---|---|---|---|---|---|
| KE-1990/SIFEL 2610 (Volume ratio) | 100:0 | 80:20 | 70:30 | 60:40 | 50:50 |
| Solvent swelling (%) | 58.0 | 48.5 | 37.0 | 28.0 | 19.2 |
| Contact angle | 117.0 | 115.3 | 114.2 | 114.5 | 118.4 |

As shown in Table 1, the IPN with a higher volume ratio of the fluoroelastomer had a lower solvent swelling degree.

Example 2

The samples in Example 1 and the foam were adhered to two sides of the supporting layer by the adhesive, thereby completing blankets. A paste made from silver particles, polymer binder, and organic solvent was filled into an intaglio pattern of an engraved plate of stainless-steel or nickel, and the intaglio pattern had a depth of 10 μm and a width of 15 μm. The blanket (on a roll) was pressed to the engraved plate by a pressure of 100N to transfer the paste from the intaglio pattern onto the blanket. The blanket was then pressed to a substrate made of poly(ethylene terephthalate) by a pressure of 180N to transfer the paste from the blanket onto the substrate. The transferred paste on the substrate had a line width as tabulated in Table 2:

TABLE 2

| | 1-1 | 1-2 | 1-3 | 1-4 |
|---|---|---|---|---|
| KE-1990/SIFEL 2610 (Volume ratio) | 80:20 | 70:30 | 60:40 | 50:50 |
| Transferred paste line width (μm) | 14.9 ± 1.0 | 13.9 ± 1.6 | 13.5 ± 0.9 | 28 ± 6.9 |

While the fluoroelastomer had a volume ratio of 50%, some paste would remain on the blanket. The residual paste on the blanket could not be improved by increasing the pressing period of the blanket pressed to the substrate. Examples 1-1 to 1-3 simultaneously meet the requirements of printing quality and solvent swelling resistance.

Example 3

Some of the samples in Example 1 and the foam were adhered to two sides of the supporting layer by the adhesive, thereby completing blankets. A paste made from silver particles, polymer binder, and organic solvent was filled into an intaglio pattern of an engraved plate of stainless-steel or nickel, and the intaglio pattern had a depth of 10 μm and a width of 15 μm. The blanket (on a roll) was pressed to the engraved plate by a pressure of 100N to transfer the paste from the intaglio pattern onto the blanket. The blanket was then pressed to a substrate made of poly(ethylene terephthalate) by a pressure of 180N to transfer the paste from the blanket onto the substrate. For the control group (pure silicone), the printing issue such as some of the paste remained on the blanket was observed when the printing being processed for 330 times, the printing issue such as a large amount of the paste remained on the blanket was observed when the printing being processed for 380 times, and the blanket needed to be baked for further use when the printing being processed for 500 times. For Example 1-1 (KE-1990/SIFEL 2610=80:20), the printing issue such as some of the paste remained on the blanket was observed when the printing being processed for 559 times, the printing issue such as a large amount of the paste remained on the blanket was observed when the printing being processed for 870 times, and the blanket needed to be baked for further use when the printing being processed for 900 times. Obviously, the IPN network could work longer than the pure silicone layer as shown in Table 3, thereby saving cost of the printing process.

TABLE 3

| | Examples | |
|---|---|---|
| Printing issue | Control group | Example 1-1 |
| Some paste remained on the blanket | After printing for 330 times | After printing for 559 times |
| A large amount of the paste remained on the blanket | After printing for 380 times | After printing for 870 times |
| Need to be baked for further use | After printing for 500 times | After printing for 900 times |

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A blanket for transferring a paste image from an engraved plate to a substrate, comprising:

a foam;

a supporting layer on the foam; and a paste transfer layer on the supporting layer, wherein the paste transfer layer is an inter-penetrating polymer network of silicone rubber and fluoroelastomer, wherein the silicone rubber and the fluoroelastomer have a volume ratio of 80:20 to 60:40, and the paste image is made of metal particles, polymer binder, and organic solvent.

2. The blanket as claimed in claim 1, wherein the foam comprises polyurethane.

3. The blanket as claimed in claim 1, wherein the foam has a thickness of 0.5 mm to 2.0 mm.

4. The blanket as claimed in claim 1, wherein the foam has a shore A hardness of 20 to 80.

5. The blanket as claimed in claim 1, wherein the supporting layer comprising polyethylene terephthalate, polyvinyl chloride, polypropylene, polyethylene, polystyrene, polyether ether ketone, polycarbonate, or polyethersulfone.

6. The blanket as claimed in claim 1, wherein the supporting layer has a thickness of 100 μm to 300 μm.

7. The blanket as claimed in claim 1, wherein the fluoroelastomer comprising perfluoropolyether with a terminal silicon having vinyl group, perfluoropolyether, or terpolymer composed of vinylidene fluoride having $—(CH_2CF_2)_x—$ subunit, hexafluoropropylene having $—(CF_2CF(CF_3))_y—$ subunit, and tetrafluoroethylene having $—(CF_2CF_2)_z—$ subunit, where x is 30 to 90 mole %, y is 10 to 70 mole %, z is 0 to 34 mole %, and x+y+z=100 mole %.

8. The blanket as claimed in claim 1, wherein a solvent swelling ratio of the paste transfer layer and a solvent swelling ratio of the silicone rubber have a ratio of 50:100 to 80:100.

9. The blanket as claimed in claim 1, wherein a surface of the paste transfer layer and water have a contact angle of 100° to 130°.

10. The blanket as claimed in claim 1, wherein the paste transfer layer has a thickness of 0.5 mm to 1 mm.

11. The blanket as claimed in claim 1, wherein the paste transfer layer has a surface roughness of 0.05 μm to 0.2 μm.

12. The blanket as claimed in claim 1, wherein the paste transfer layer has a fluorine content of 2.5 wt % to 50 wt %.

13. The blanket as claimed in claim 1, further comprising a silicone rubber layer disposed on the paste transfer layer, between the paste transfer layer and the supporting layer, or a combination thereof.

14. The blanket as claimed in claim 13, wherein the silicone rubber layer has a thickness of 0.5 mm to 1 mm.

15. The blanket as claimed in claim 1, further comprising an adhesive between the foam and the supporting layer, between the supporting layer and the paste transfer layer, or a combination thereof.

16. The blanket as claimed in claim 1, wherein the silicone rubber in the inter-penetrating polymer network is cured by addition cure, peroxide cure, or condensation cure.

* * * * *